US011340035B2

(12) United States Patent
Gillette

(10) Patent No.: US 11,340,035 B2
(45) **Date of Patent: *May 24, 2022**

(54) TRIGGER ASSEMBLY

(71) Applicant: VARANGIAN INVESTMENTS, LLC, Midway, UT (US)

(72) Inventor: Miles Lewis Gillette, Logan, UT (US)

(73) Assignee: VARANGIAN INVESTMENTS, LLC, Midway, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/909,707

(22) Filed: Jun. 23, 2020

(65) Prior Publication Data

US 2021/0071974 A1 Mar. 11, 2021

Related U.S. Application Data

(63) Continuation of application No. 16/469,753, filed as application No. PCT/US2018/015433 on Jan. 26, (Continued)

(51) Int. Cl.

| | |
|---|---|
| ***F41A 19/10*** | (2006.01) |
| ***F41A 19/14*** | (2006.01) |
| ***F41A 19/12*** | (2006.01) |

(52) U.S. Cl.

CPC ..... *F41A 19/10* (2013.01); *F41A 19/12* (2013.01); *F41A 19/14* (2013.01)

(58) Field of Classification Search

CPC ..... F41A 19/10; F41A 19/12; F41A 19/14

See application file for complete search history.

(56) References Cited

U.S. PATENT DOCUMENTS

| | | | |
|---|---|---|---|
| 2,462,585 | A | 2/1949 | Wesson |
| 2,765,561 | A | 10/1956 | Morris |

(Continued)

FOREIGN PATENT DOCUMENTS

| | | | |
|---|---|---|---|
| DE | 1904675 | A1 | 8/1970 |
| DE | 9106615 | U1 | 8/1991 |

(Continued)

OTHER PUBLICATIONS

Machine translation of DE-102009029951-A1 (Year: 2010).*

(Continued)

*Primary Examiner* — Joshua T Semick

(74) *Attorney, Agent, or Firm* — Dorsey & Whitney LLP

(57) ABSTRACT

A trigger assembly apparatus includes spherical portion(s) and spherical bearing(s), rounded sear, stabilizing catch, and complimentary shield. In an exemplary embodiment, the spherical portion(s) and spherical bearing(s) respond to non-linear movement. Further, the interaction of the spherical portion(s) and spherical bearing(s) results in the mobility of the trigger in relation to the 6 degrees of freedom thereby resulting in the firearm being generally unaffected by side to side movement of the trigger during activation. The trigger assembly may also include but is not limited to a rounded sear, stabilizing catch, and complimentary shield. The rounded portion of the sear engages the hammer stop notch at a single point further resulting in the firearm being generally unaffected by side to side movement of the trigger. Additionally the stabilizing catch and shield helps facilitate the proper reset of the trigger assembly.

13 Claims, 6 Drawing Sheets

Related U.S. Application Data

2018, now Pat. No. 10,724,815, which is a continuation-in-part of application No. 15/424,436, filed on Feb. 3, 2017, now Pat. No. 10,222,160.

(56) References Cited

U.S. PATENT DOCUMENTS

| | | | | |
|---|---|---|---|---|
| 4,392,319 | A | 7/1983 | Ottolini | |
| 4,581,835 | A | 4/1986 | Brouthers et al. | |
| 4,648,190 | A | 3/1987 | Allen | |
| 5,635,664 | A * | 6/1997 | Pons | F41A 19/44 42/69.03 |
| 6,460,281 | B1 | 10/2002 | Schaeffer | |
| 6,640,479 | B2 | 11/2003 | Gühring et al. | |
| 6,651,542 | B2 | 11/2003 | Danner et al. | |
| 6,769,208 | B2 | 8/2004 | Beretta | |
| 6,976,416 | B2 | 12/2005 | Ealovega | |
| 6,978,568 | B2 | 12/2005 | Jewell | |
| 7,010,879 | B2 | 3/2006 | Olson | |
| 7,051,638 | B2 | 5/2006 | Thomele | |
| 7,076,902 | B2 | 7/2006 | Hengstenberg et al. | |
| 7,156,662 | B2 * | 1/2007 | Goko | F41A 19/16 362/111 |
| 7,162,824 | B1 | 1/2007 | McCormick | |
| 7,257,918 | B2 | 8/2007 | Moore | |
| 7,263,796 | B2 | 9/2007 | Kellermann et al. | |
| 7,293,385 | B2 | 11/2007 | McCormick | |
| 7,331,136 | B2 | 2/2008 | Geissele | |
| 7,600,338 | B2 | 10/2009 | Geissele | |
| 7,743,543 | B2 | 6/2010 | Karagias | |
| 7,992,335 | B2 | 8/2011 | Gangl | |
| 8,069,602 | B2 | 12/2011 | Geissele | |
| 8,074,393 | B2 | 12/2011 | Geissele | |
| 8,099,895 | B2 | 1/2012 | Farley, Jr. et al. | |
| 8,109,025 | B2 | 2/2012 | Stone | |
| 8,117,779 | B2 | 2/2012 | Doll et al. | |
| 8,122,634 | B2 | 2/2012 | Constant et al. | |
| 8,176,836 | B2 | 5/2012 | Peev | |
| 8,225,705 | B2 | 7/2012 | Dubois et al. | |
| 8,250,799 | B2 | 8/2012 | Duperry et al. | |
| 8,281,704 | B2 | 10/2012 | Kerbrat et al. | |
| 8,312,658 | B2 | 11/2012 | Lippard | |
| 8,359,778 | B2 | 1/2013 | Doll et al. | |
| 8,468,732 | B2 | 6/2013 | Young | |
| 8,490,309 | B2 | 7/2013 | Zukowski | |
| 8,510,980 | B2 | 8/2013 | Lee | |
| 8,522,466 | B2 | 9/2013 | Arduini | |
| 8,528,241 | B2 | 9/2013 | Pichler | |
| 8,572,880 | B2 | 11/2013 | Bender | |
| 8,756,843 | B1 | 6/2014 | Cantrell | |
| 8,850,734 | B2 | 10/2014 | Lupher et al. | |
| 8,857,090 | B2 | 10/2014 | Aigner | |
| 8,863,425 | B2 | 10/2014 | Lee | |
| 8,875,432 | B2 | 11/2014 | Goddard | |
| 8,893,607 | B2 | 11/2014 | Audibert et al. | |
| 8,904,690 | B1 | 12/2014 | Cantrell | |
| 8,985,006 | B1 | 3/2015 | Christensen et al. | |
| 8,985,007 | B2 | 3/2015 | Larson, Jr. et al. | |
| 9,046,313 | B1 | 6/2015 | Lutton et al. | |
| 9,052,150 | B2 | 6/2015 | Talasco | |
| 9,068,792 | B2 | 6/2015 | Macy | |
| 9,097,485 | B2 | 8/2015 | Lipowski | |
| 9,121,654 | B2 | 9/2015 | Arnedo Vera et al. | |
| 9,146,067 | B2 | 9/2015 | Stakes | |
| 9,163,890 | B2 | 10/2015 | Heizer | |
| 9,170,063 | B2 | 10/2015 | Krieger | |
| 9,175,916 | B2 | 11/2015 | Tasyagan | |
| 9,175,917 | B2 | 11/2015 | Bender | |
| 9,267,751 | B2 | 2/2016 | Ruiz | |
| 9,310,150 | B1 * | 4/2016 | Geissele | F41A 19/10 |
| 9,347,725 | B2 | 5/2016 | Mcalister | |
| 9,389,037 | B2 | 7/2016 | Reynolds | |
| 9,404,701 | B2 | 8/2016 | Lipowski | |
| 9,410,760 | B2 | 8/2016 | Siddle | |
| 9,541,341 | B2 | 1/2017 | Macy | |
| 9,562,731 | B2 | 2/2017 | Geissele | |
| 9,573,268 | B2 | 2/2017 | Azhocar | |
| 9,599,420 | B2 | 3/2017 | Moretti | |
| 9,612,072 | B2 | 4/2017 | Hochstrate et al. | |
| 9,612,073 | B2 | 4/2017 | Parajon | |
| 9,618,288 | B2 | 4/2017 | Wilson | |
| 9,618,289 | B1 | 4/2017 | Geissele | |
| 9,625,227 | B2 | 4/2017 | Lee | |
| 9,631,886 | B2 | 4/2017 | Findlay | |
| 9,638,485 | B2 | 5/2017 | Geissele | |
| 9,644,913 | B2 | 5/2017 | Dextraze | |
| 9,658,014 | B2 | 5/2017 | Anglisani | |
| 9,671,187 | B2 | 6/2017 | Colman | |
| 9,677,836 | B2 | 6/2017 | Lee | |
| 9,683,800 | B2 | 6/2017 | Sewell, Jr. et al. | |
| 9,714,804 | B2 | 7/2017 | Singh | |
| 9,718,182 | B2 | 8/2017 | Azhocar | |
| 9,739,557 | B2 | 8/2017 | Lee | |
| 9,746,271 | B2 | 8/2017 | Hughes et al. | |
| 9,752,841 | B2 | 9/2017 | Lipowski | |
| 9,759,504 | B2 | 9/2017 | Geissele | |
| 9,803,945 | B2 | 10/2017 | Audibert et al. | |
| 9,816,771 | B2 | 11/2017 | Ghitti | |
| 9,823,032 | B2 | 11/2017 | Allan | |
| 9,835,398 | B2 | 12/2017 | Biegel | |
| 9,863,730 | B2 * | 1/2018 | Elftmann | F41A 19/10 |
| 9,927,197 | B1 * | 3/2018 | Geissele | F41A 19/44 |
| 9,927,200 | B2 | 3/2018 | Kuracina | |
| 10,222,160 | B2 | 3/2019 | Gillette | |
| 2001/0042332 | A1 | 11/2001 | Gering et al. | |
| 2003/0172571 | A1 | 9/2003 | West | |
| 2006/0101695 | A1 | 5/2006 | Longueira | |
| 2007/0051236 | A1 | 3/2007 | Groves et al. | |
| 2008/0060245 | A1 | 3/2008 | McCormick | |
| 2009/0158634 | A1 | 6/2009 | Bubits | |
| 2009/0188145 | A1 | 7/2009 | Fluhr et al. | |
| 2010/0281739 | A1 | 11/2010 | Geissele | |
| 2011/0030261 | A1 | 2/2011 | Karagias | |
| 2011/0067283 | A1 | 3/2011 | Baker | |
| 2011/0167691 | A1 | 7/2011 | Bowman et al. | |
| 2011/0185615 | A1 | 8/2011 | Gangl | |
| 2013/0104435 | A1 | 5/2013 | Fuller | |
| 2013/0174459 | A1 | 7/2013 | Moretti | |
| 2013/0269233 | A1 | 10/2013 | Chin | |
| 2014/0311006 | A1 | 10/2014 | Kott | |
| 2014/0311007 | A1 | 10/2014 | Capps et al. | |
| 2015/0020426 | A1 | 1/2015 | Neergaard | |
| 2016/0018176 | A1 | 1/2016 | Fellows et al. | |
| 2016/0040948 | A1 | 2/2016 | Barrett et al. | |
| 2016/0061549 | A1 | 3/2016 | Patterson et al. | |
| 2016/0131448 | A1 | 5/2016 | Bender | |
| 2016/0187092 | A1 | 6/2016 | Mather et al. | |
| 2016/0327357 | A1 | 11/2016 | Wheatley | |
| 2016/0356568 | A1 | 12/2016 | Kuracina | |
| 2016/0363401 | A1 | 12/2016 | Elftmann | |
| 2016/0370140 | A1 | 12/2016 | Geissele | |
| 2017/0003090 | A1 | 1/2017 | Kokinis et al. | |
| 2017/0045318 | A1 | 2/2017 | Verney-Carron | |
| 2017/0059267 | A1 | 3/2017 | Hudson et al. | |
| 2017/0067715 | A1 | 3/2017 | Conant et al. | |
| 2017/0097204 | A1 | 4/2017 | Geissele | |
| 2017/0102200 | A1 | 4/2017 | Alicea, Jr. | |
| 2017/0122686 | A1 | 5/2017 | Fellows et al. | |
| 2017/0131058 | A1 | 5/2017 | McPherson et al. | |

FOREIGN PATENT DOCUMENTS

| | | | | |
|---|---|---|---|---|
| DE | 102009029951 | A1 * | 12/2010 | F41A 19/10 |
| DE | 102009029951 | A1 | 12/2010 | |
| DE | 102009029951 | B4 | 3/2011 | |
| DE | 102016109695 | A1 | 11/2017 | |
| GB | 263621 | A | 1/1927 | |
| WO | 2015106759 | A1 | 7/2015 | |
| WO | WO-2015106759 | A1 * | 7/2015 | F41A 19/12 |

(56) References Cited

OTHER PUBLICATIONS

International Search Report and Written Opinion from International Application No. PCT/US2018/015433 dated Mar. 16, 2018.
Issue Notification for U.S. Appl. No. 15/424,436 dated Feb. 13, 2019.
Non-Final Office Action for U.S. Appl. No. 15/424,436 dated Feb. 2, 2018.
Non-Final Office Action for U.S. Appl. No. 16/469,753 dated Sep. 3, 2019.
Notice of Allowance for U.S. Appl. No. 15/424,436 dated Nov. 1, 2018.
Notice of Allowance for U.S. Appl. No. 15/424,436 dated Jul. 10, 2018.
Notice of Allowance for U.S. Appl. No. 16/469,753 dated Mar. 25, 2020.
Restriction Requirement for U.S. Appl. No. 15/424,436 dated Oct. 5, 2017.
U.S. Appl. No. 15/424,436, filed Feb. 3, 2017.
U.S. Appl. No. 16/469,753, filed Jun. 14, 2019.
"15 minute trigger job?", http://www.predatormastersforums.com/forums/ubbthreads.php?ubb=showflat&Number=1555088, post by user Juice1050, 2010, pp. 2-5.

* cited by examiner

TRIGGER ASSEMBLY

CROSS-REFERENCE TO RELATED APPLICATIONS

This application is a continuation of U.S. patent application Ser. No. 16/469,753 filed on Jun. 14, 2019, which is a U.S. National Stage Application of International Application No. PCT/US2018/015433 filed Jan. 26, 2018, which claims priority to U.S. patent application Ser. No. 15/424,436 filed on Feb. 3, 2017, the disclosure of each of which is incorporated herein in its entirety by this reference.

BACKGROUND

Firearms and instruments with similar functions typically employ a traditional trigger assembly apparatus mechanism. Traditional trigger assemblies are configured to activate in response to linear motion. A standard traditional trigger assembly, for example, responds to pressure exerted linearly. A standard traditional trigger assembly includes a sear. The sear functions to hold the hammer, striker or other equivalent portion of the firearm in place until the user activates the trigger by applying pressure. When the pressure on a standard traditional trigger reaches a predetermined level, the sear releases allowing the hammer, striker or other equivalent portion of the firearm to engage resulting in discharging the firearm. Often the pressure exerted on the trigger by the user will include a non-linear motion portion. Numerous users find that this non-linear pressure causes the firearm to pull to one side resulting in less accuracy, commonly referred to as trigger pull. Many users employ various mitigating techniques to attempt to improve accuracy and compensate for trigger pull. Further, users engaged in competitions or other activities requiring accuracy devote substantial time and effort to various mitigating techniques.

SUMMARY

An embodiment of a trigger assembly is disclosed. The trigger assembly includes a trigger, a hammer including a stop notch, a sear adapted to engage the stop notch to hold the hammer in a cocked position, and a disconnector that rotates around a disconnector pin and a spherical portion engaging the disconnector pin. The trigger assembly includes a spherical bearing engaging the spherical portion, wherein the spherical bearing is adapted to move about the spherical portion thereby responding to pressure on the trigger in all six degrees of freedom such that, upon activation, the sear disengages from the stop notch.

Another embodiment of trigger assembly is disclosed. The trigger assembly includes a trigger, a hammer; a sear including a rounded end adapted to engage and hold the hammer in a cocked position, and a ball joint operably coupled to the trigger and configured to respond to pressure on the trigger in all six degrees of freedom such that, upon activation, the sear disengages from the hammer.

Yet another embodiment of trigger assembly is disclosed. The trigger assembly includes a trigger and one or more ball joints that engage the trigger. Each of the one or more ball joints includes a spherical bearing element and a bearing seat that receives the spherical bearing element, wherein the one or more ball joints are configured to enable the trigger to move in six degrees of freedom such that the trigger is configured to be activated through force applied to the trigger in any of the six degrees of freedom.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The accompanying drawings illustrate various examples of the exemplary embodiments described herein and are a part of the specification. The illustrated exemplary embodiments are merely examples and do not limit the scope of the claims:

Throughout the drawings, identical reference numbers designate similar, but not necessarily identical, elements.

DETAILED DESCRIPTION

Throughout this description and in the accompanying drawings reference is made to principles of the invention through the use of exemplary embodiments. It should be understood that the application is not limited to the details or specific methodologies set forth herein. It should also be understood that the terminology used herein is for the purpose of description only and should not be regarded as limiting.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1:
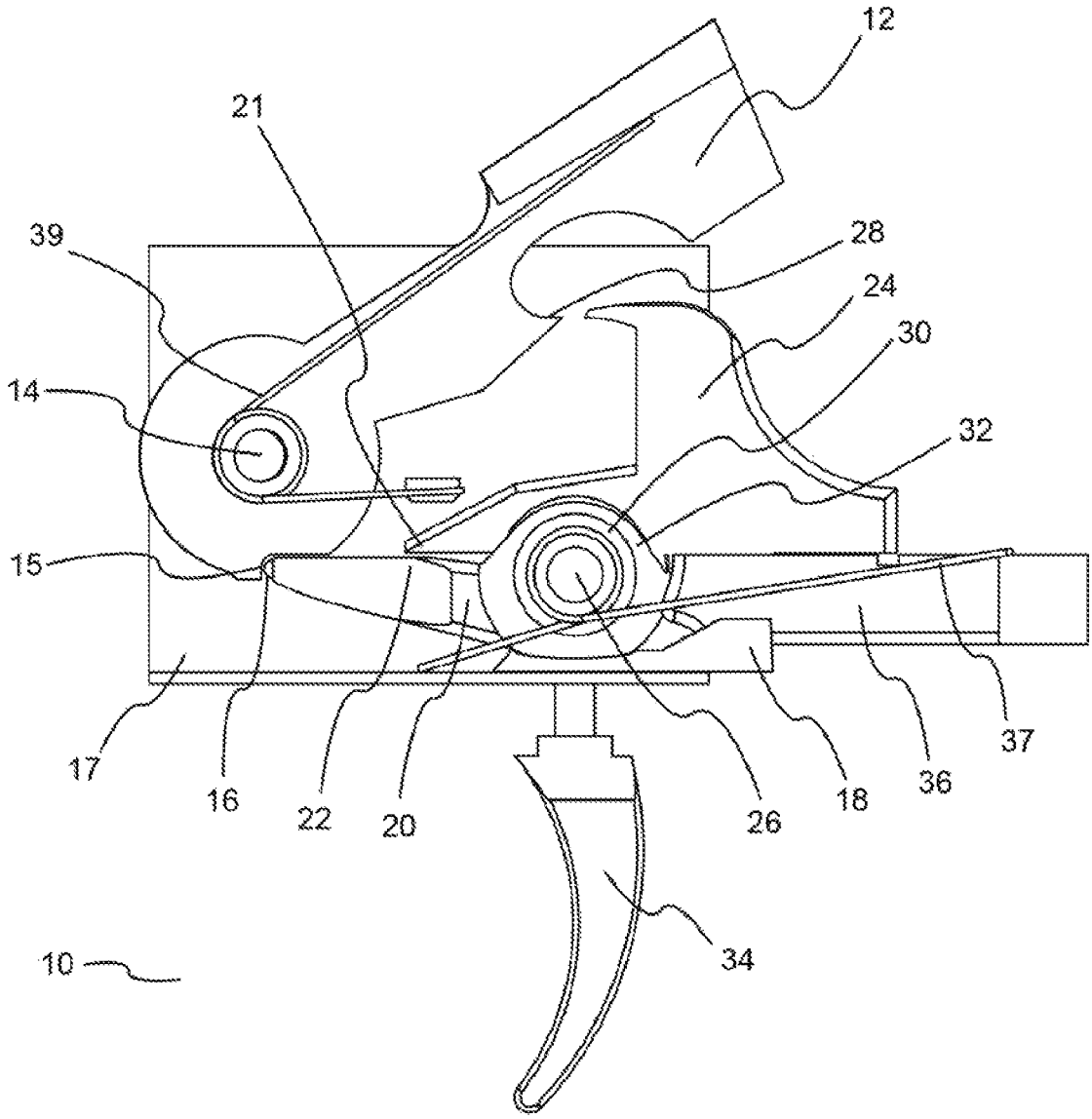
FIG. 1 is a cut-away view of a trigger assembly apparatus that includes a spherical portion according to an exemplary embodiment described herein.
Figure 2:
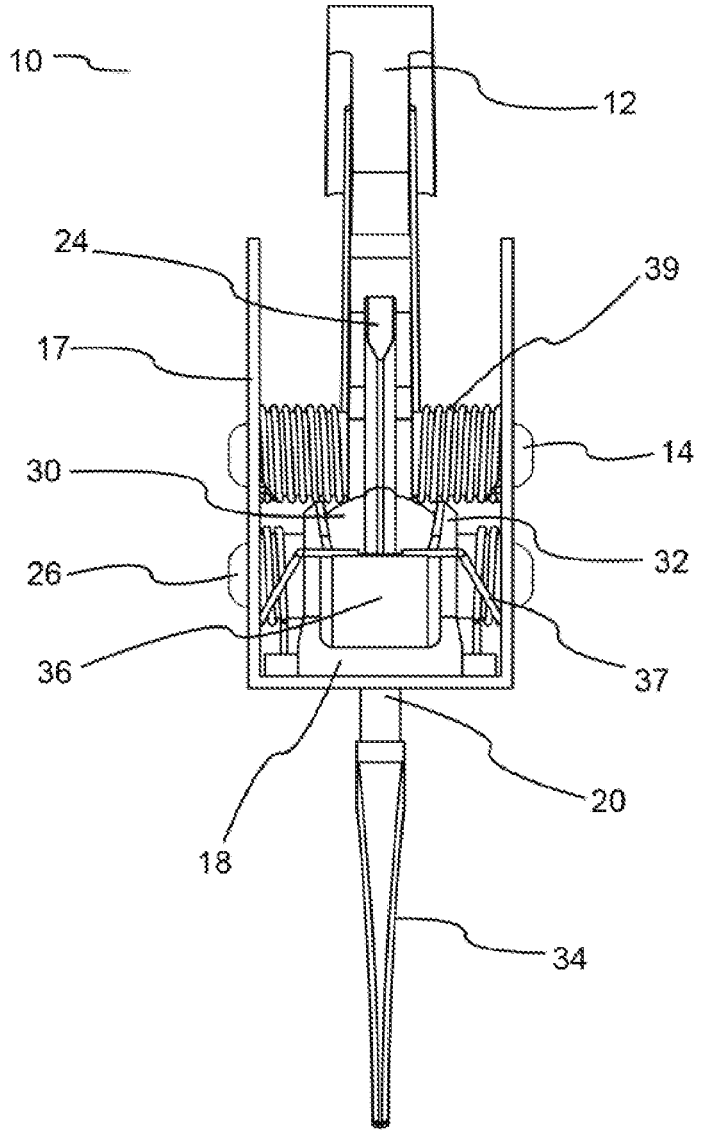
FIG. 2 is a rear view of a trigger assembly apparatus of a like embodiment as illustrated in FIG. 1 according to an exemplary embodiment described herein.
Figure 3:
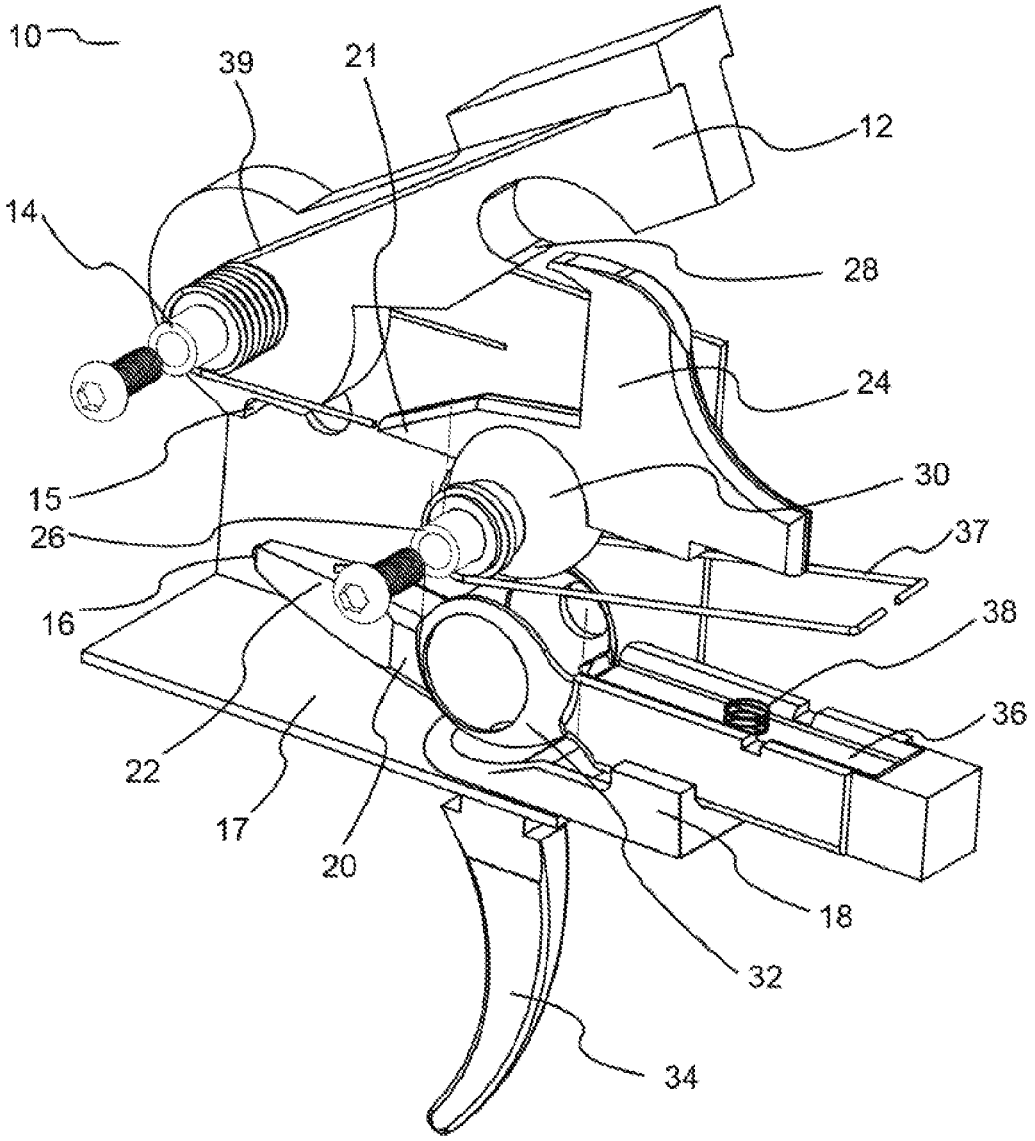
FIG. 3 is a perspective exploded view of a trigger assembly apparatus of a like embodiment as illustrated in FIG. 1 according to an exemplary embodiment described herein.

Referring initially to FIGS. 1 through 3, an exemplary embodiment of the overall trigger assembly apparatus 10 taught by the invention provides a hammer 12 which rotates around a hammer pin 14. A hammer spring 39 provides constant tension on hammer 12. Hammer 12 incorporates a stop notch 15 into which sear 16 fits. Sear 16 is a rounded tip on the anterior of trigger element 20 that engages with hammer 12 at hammer stop notch 15.

In this exemplary embodiment, the trigger assembly apparatus 10, as designed for rifle platforms such as the Armalite platform but adaptable for use on other firearm platforms, also includes disconnector 24 that rotates around disconnector pin 26. If hammer 12 is drawn back far enough in the act of resetting or cocking, disconnector 24 is able to engage a catch nose 28 on hammer 12. This style of trigger assembly apparatus may be used on rifle platforms such as the Armalite platform but Disconnector 24 incorporates an anterior portion 21 and a spherical portion 30 generally centered on the axis of disconnector pin 26.

Trigger element 20 incorporates an anterior portion 22, sear 16, trough 36, trigger 34 and a spherical bearing 32. Spherical bearing 32 engages spherical portion 30 thereby enabling any combination of the 6 degrees of motion from pressure on trigger 34. Sear 16 is rounded to allow freedom of movement within hammer stop notch 15. As trigger element 20 moves about spherical portion 30, sear 16 reduces any adverse pressure against hammer 12 and against the firearm. Sear 16 is positioned so that when trigger 34 is pulled backward, trigger element 20 rotates and sear 16 disengages from hammer stop notch 15.

Trigger spring 37 engages trigger element 20 and provides the force necessary to keep trigger element 20 in a resting position. In this position, trigger element 20 engages stabilizing catch 18 so that trigger 36 is held in a generally vertical orientation. Once trigger 34 is pulled backward, trigger element 20 disengages from stabilizing catch 18, allowing trigger element 20 to rotate freely.

Trough 36 of trigger element 20 receives the posterior of disconnector 24. Trough spring 38 is located within trough 36 and applies force to disconnector 24 so that it favors engagement with catch nose 28 on hammer 12 after hammer 12 has been released and is forced back to be reset as part of the firing cycle. However, anterior portion of disconnector 21 is spaced appropriately from the anterior of trigger element 22 such that when trigger 34 is released by the operator, the torque applied to trigger element 20 by trigger spring 37 causes trigger 34 to move into a forward motion. This motion forces the anterior of trigger element 22 upward against anterior portion of disconnector 21, causing disconnector 24 to rotate backward about disconnector pin 26. This rotation forces disconnector 24 backwards with a downward force against trough spring 38, thereby allowing disconnector 24 to dip into trough 36 and disengage from catch nose 28 on hammer 12 at a time when trigger element 20 is in the proper reset position with sear 16 fitting back into hammer stop notch 15.

When trigger 34 is pulled backward, trigger element 20 rotates with any combination of the 6 degrees of freedom about spherical bearing 30. This freedom of motion for trigger element 20 changes the angle of contact between sear 16 and hammer stop notch 15. The rounded design of sear 16 allows it to rotate within hammer stop notch 15 preventing adverse pressure on hammer 12 as sear 16 disengages from hammer stop notch 15 with backward motion of trigger element 20. The backward motion of trigger element 20 caused by the user's pressure on trigger 34, forces trough 36 in an upward motion. Trough spring 38 transfers the forward motion of trough 36 to disconnector 24. This causes disconnector 24 to rotate forward about disconnector pin 26. Disconnector 24 is spaced from hammer 12 as to allow disconnector 24 to rotate forward without initially engaging catch nose 28 on hammer 12.

Pulling trigger 34 farther backward continues the downward motion on the anterior of trigger element 22. Sear 16, located on the anterior of trigger element 22, then disengages with hammer 12 at hammer stop notch 15. As sear 16 disengages from hammer stop notch 15, hammer 12 is forced to rotate forward about hammer pin 14 due to the tension of hammer spring 39. This release of hammer 12 allows it to strike firing pin (not shown). After the round (not shown) has been fired, hammer 12 is driven back from the force of the discharge as the bolt carrier assembly in the upper receiver (not shown) is driven rearward to cycle the firearm.

Upon discharge of the firearm in selected semi-automatic fire, hammer 12 is driven back far enough that disconnector 24 engages catch nose 28 and prevents hammer 12 from rotating and hitting the firing pin (not shown) a second time. When trigger 34 is eventually released, trigger element 20 is forced back into its resting position by trigger spring 37 with sear 16 in position ready to connect with hammer stop notch 15. This resetting motion of trigger element 20 results in the anterior of trigger element 22 making contact with the anterior portion of disconnector 21, forcing disconnector 24 to rotate backwards. This backward motion of disconnector 24 is just enough to disengage disconnector 24 from catch nose 28. This results in hammer 12 rotating forward slightly until hammer stop notch 15 engages sear 16. The trigger assembly is then completely reset and ready to be cycled again.

Because spherical bearing 32 of trigger element 20 bears around spherical portion 30 of disconnector 24, trigger element 20 has the ability to move in any combination of the 6 degrees of motion such as up/down, left/right, forward/backward as well as rotation about perpendicular axes commonly known as pitch, yaw and roll.

This result of this configuration is that when the firearm is fired, side-to-side forces on trigger 34 are reduced, and consequently do not have the same effect on the firearm as a traditional trigger confined to linear motion. Rounding the end of sear 16 so it engages hammer stop notch 15 at a single point allows the trigger assembly apparatus 10 to be generally immune to adverse effects of side-to-side forces. Thus, if trigger 34 moves side-to-side, sear 16 simply rotates within hammer stop notch 15 maintaining about the single point of contact where sear 16 engages hammer stop notch 15 without danger of it disengaging from notch 15. The trigger assembly apparatus 10 is held together as one unit with case 17, creating a self-contained trigger system and thereby providing structure and stability to the trigger apparatus while allowing trigger 34 to move appropriately.

Figure 4:
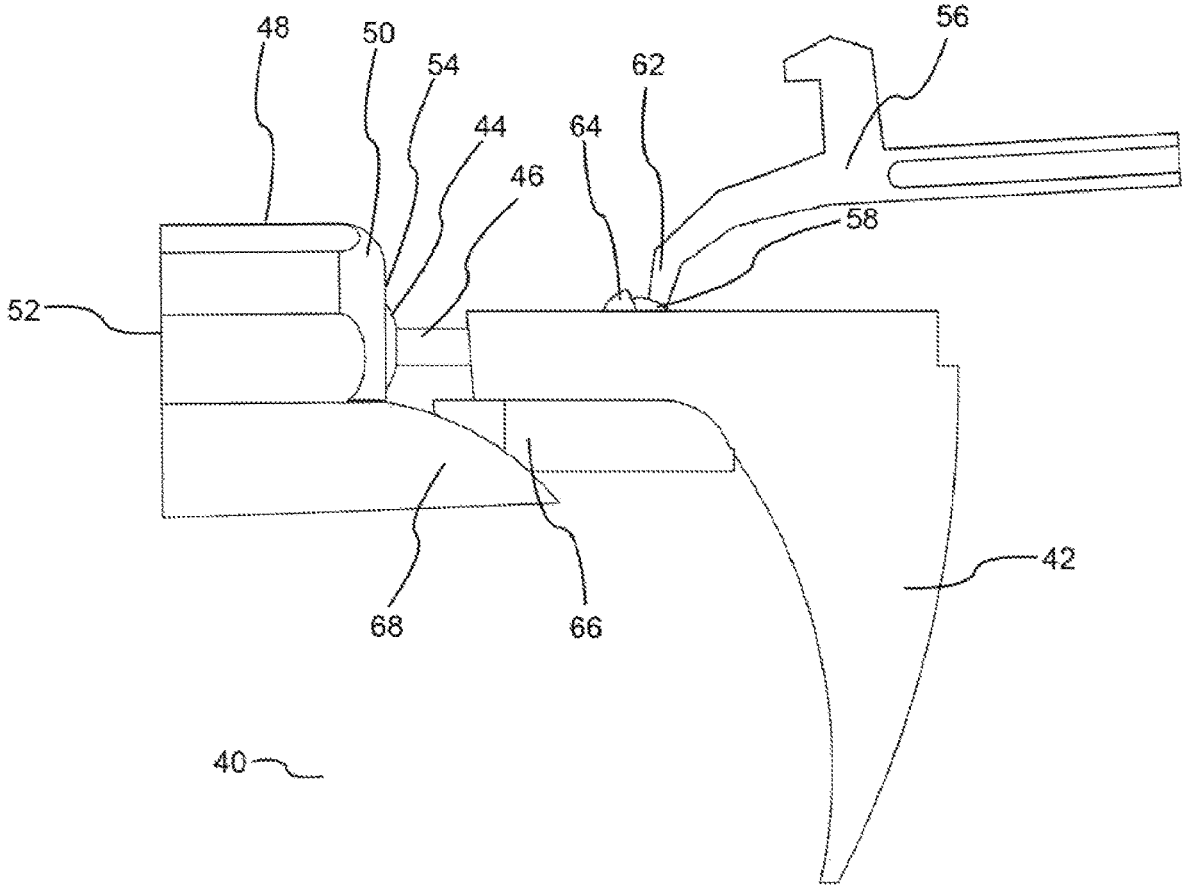
FIG. 4 is a side view of a trigger assembly apparatus that includes a spherical portion according to an additional exemplary embodiment described herein.
Figure 5:
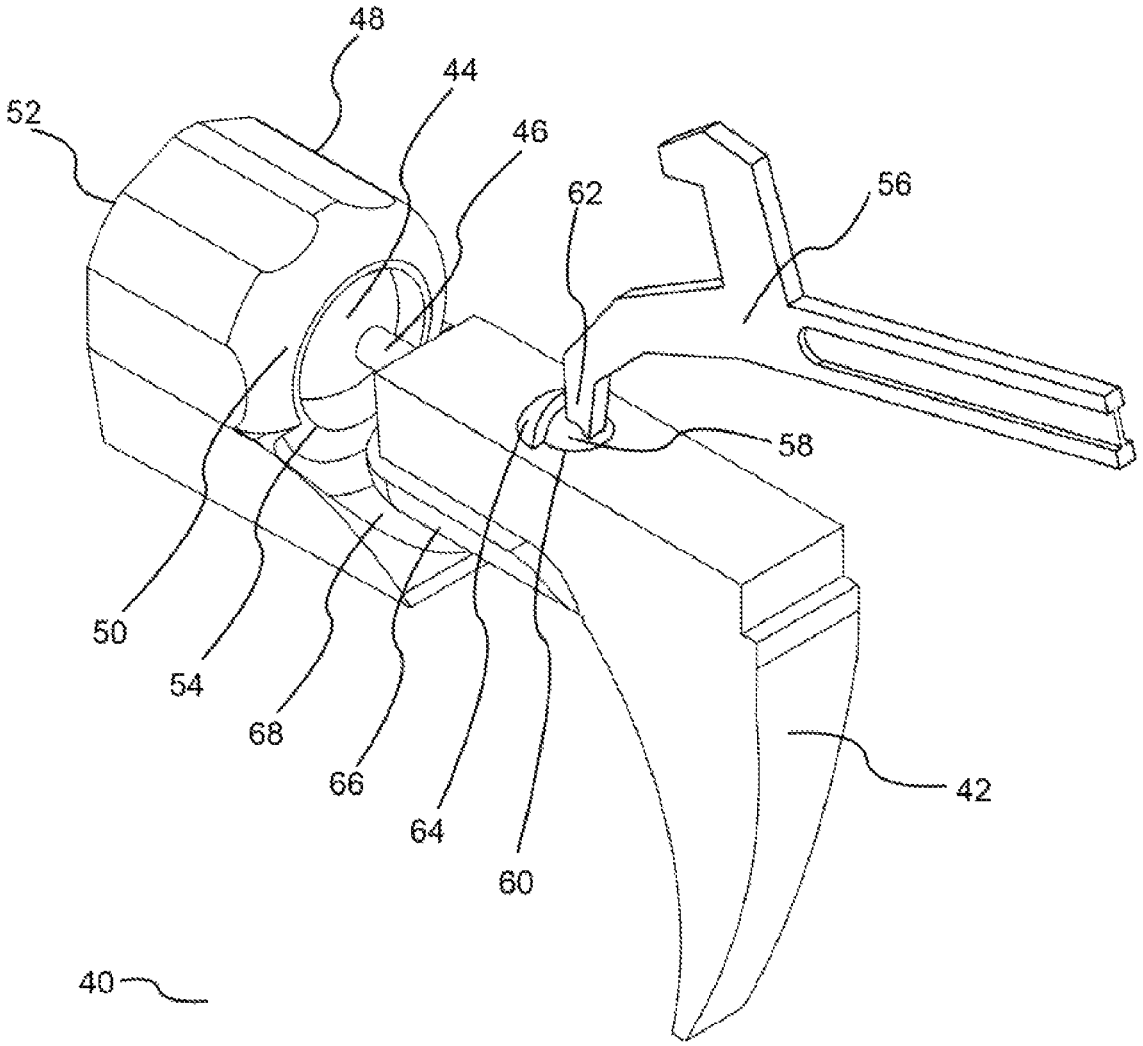
FIG. 5 is a perspective view of a trigger assembly apparatus of a like embodiment as illustrated in FIG. 4 according to an exemplary embodiment described herein.
Figure 6:
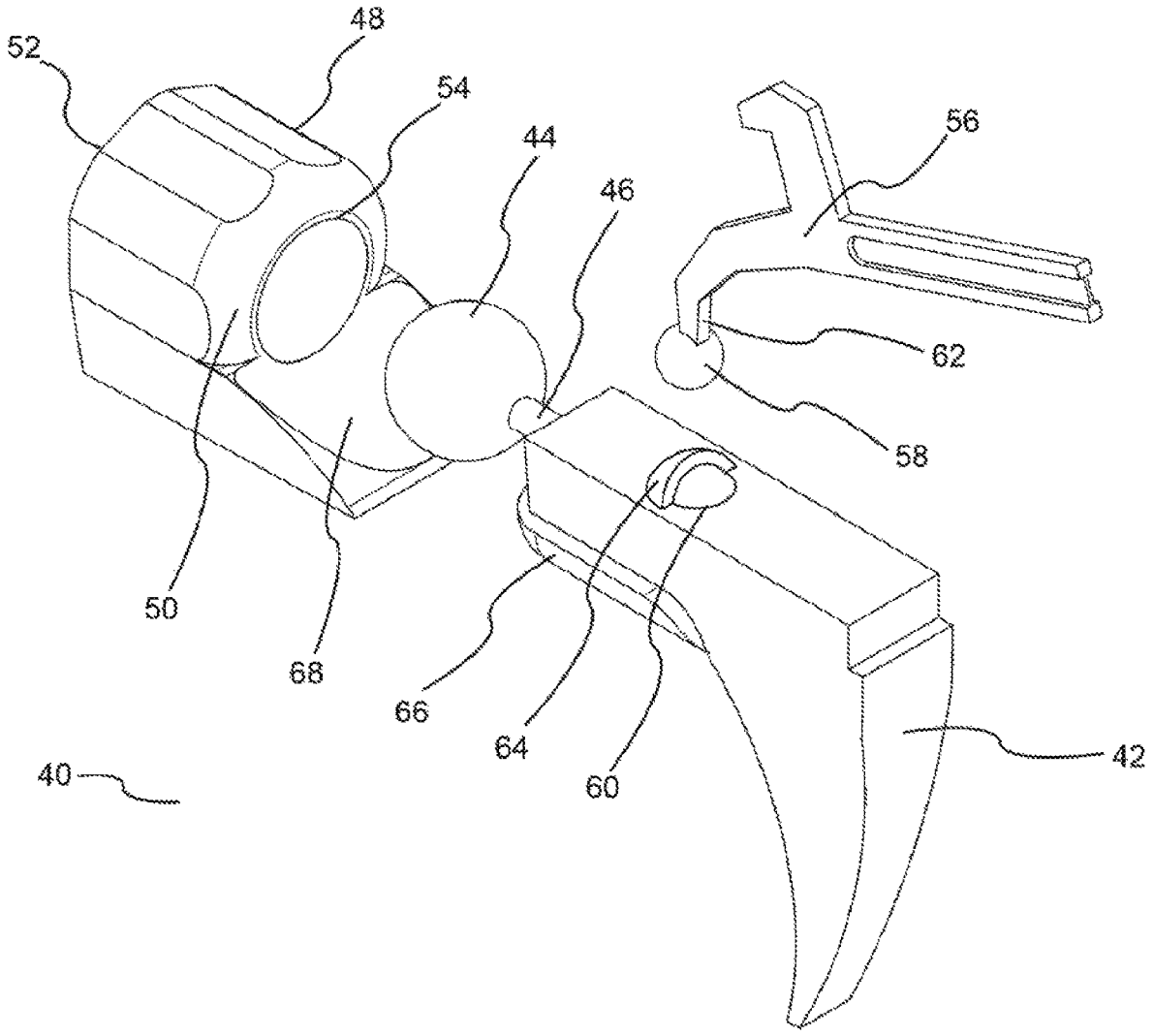
FIG. 6 is a perspective exploded view of a trigger assembly apparatus of a like embodiment as illustrated in FIG. 4 according to an exemplary embodiment described herein.

Referring to FIGS. 4 through 6, an additional exemplary embodiment of the invention, trigger assembly apparatus 40, is shown. In this embodiment, trigger 42 is connected to a first spherical portion 44 by connecting portion 46. First spherical portion 44 mates with first spherical bearing 48 providing a ball joint. First spherical bearing 48 includes posterior side 50 and anterior side 52. First spherical bearing 48 is affixed to the firearm. As shown, first spherical bearing 48 is oriented so that opening 54, that accepts first spherical portion 44 is on the posterior side 50 of first spherical bearing 48, but it will be understood that any orientation could be used.

Connecting portion 46 substantially rigidly attaches first spherical portion 44 to trigger 42. Connecting portion 46 attaches first spherical portion 44 such that trigger 42 does not interfere with first spherical bearing 48. Thus, the substantially rigid connection of first spherical portion 44 to trigger 42 by connecting portion 46 allows trigger 42 rotate in substantially all degrees of rotational freedom.

Trigger 42 contains a substantially hemispherical second spherical bearing 60 that mates with a second spherical portion 58. Connecting bar 62 substantially rigidly attaches second spherical portion 58 to trigger bar 56. Shield 64 is a protruding extension of second spherical bearing 60 that is attached to trigger 42 and serves both to capture second spherical portion 58 and to allow proper reset of connecting bar 62 when sliding forward. Trigger bar 56 connects to the trigger mechanism housing with ejector (not shown) such that upward and rearward movement of trigger bar 56 initiates the firing process. This configuration allows rearward motion of trigger 42 to translate into upward and rearward movement of trigger bar 56, while rotation of trigger 42 about any other axis has no appreciable effect.

When trigger 42 is in its resting position, rounded bottom front portion 66 of trigger 42 mates with stabilizing catch 68. Stabilizing catch 68 is attached to first spherical bearing 48. The rounded bottom front portion 66 and stabilizing catch 68 are kept tightly seated by the forward and downward force of trigger bar 56 upon trigger 42.

When trigger 42 is pulled backward, rounded bottom front portion 66 disengages from stabilizing catch 68, allowing trigger 42 to rotate freely about first spherical portion 44. This isolates the firearm both from side-to-side forces and from torques about axis A-A. A-A is the axis formed by the centers of first spherical portion 44 and second spherical portion 58. In contrast, backward motion of trigger 42 is translated to trigger bar 56 independent of orientation. Thus, when the firearm is fired, side-to-side forces and torques on trigger 42 will not adversely affect the operator's aim.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A trigger assembly, comprising:

a socket in a trigger mechanism;

a spherical portion disposed in the socket, the spherical portion being at least partially spherical; and a trigger connected to and extending from the spherical portion by a rigid connection therebetween, thereby allowing the trigger to rotate about the spherical portion in any combination of roll, pitch, and yaw and to initiate a firing process of the trigger mechanism when the trigger is pulled backwards.

2. The trigger assembly of claim 1 wherein the socket is defined by a spherical bearing having an anterior side, a posterior side, and an opening in the posterior side for receiving the spherical portion therein.

3. The trigger assembly of claim 1, further comprising a connecting portion that connects the spherical portion to the trigger thereby creating the rigid connection therebetween.

4. The trigger assembly of claim 1 wherein the socket of the trigger mechanism is affixed to a firearm.

5. The trigger assembly of claim 2 wherein the opening is sized and shaped to accommodate the entire spherical portion therein.

6. The trigger assembly of claim 2 wherein the opening is sized and shaped to allow the spherical portion therein to rotate therein.

7. A trigger assembly, comprising:

a socket;

a spherical portion disposed in the socket, the spherical portion being at least partially spherical; and a trigger connected to and extending from the socket via a rigid connection therebetween to allow the trigger to rotate about the spherical portion to articulate in any combination of roll, pitch, and yaw and to initiate a firing process when the trigger is pulled backwards.

8. The trigger assembly of claim 7 wherein the trigger includes a trigger arm connected to the socket via the rigid connection.

9. The trigger assembly of claim 7 wherein the socket is shaped at least partially complementary to the spherical portion to allow the spherical portion to at least partially rotate within the socket.

10. The trigger assembly of claim 7, further comprising a disconnector, wherein the spherical portion is connected to the disconnector.

11. The trigger assembly of claim 10, further comprising a hammer, wherein the hammer is shaped to releasably engage the disconnector.

12. The trigger assembly of claim 7, further comprising a hammer, wherein a portion of the trigger engages the hammer to retain the hammer in a cocked position until the trigger is pulled backward.

13. The trigger assembly of claim 7 wherein the portion of the trigger that engages the hammer includes a sear extending from the trigger.

* * * * *